US006060976A

United States Patent [19]

Yamaguchi et al.

[11] Patent Number: 6,060,976

[45] **Date of Patent: *May 9, 2000**

[54] PLANE TRANSFORMER

[75] Inventors: Takashi Yamaguchi; Ichiro Sasada, both of 1-7 Yukigaya, Otsuka-cho, Ota-ku, Tokyo, Japan

[73] Assignees: Alps Electric Co., Ltd.; Takashi Yamaguchi; Ichiro Sasada, all of, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/790,029

[22] Filed: Jan. 28, 1997

[30] Foreign Application Priority Data

Jan. 30, 1996 [JP] Japan ..... 8-014653

[51] Int. Cl.[7] ..... H01F 5/00; H01F 27/28

[52] U.S. Cl. ..... 336/200; 336/223; 336/232; 336/233; 336/83

[58] Field of Search ..... 336/200, 216, 336/222, 223, 232, 174, 145, 206, 212, 233, 83

[56] References Cited

U.S. PATENT DOCUMENTS

| | | | |
|---|---|---|---|
| 4,009,460 | 2/1977 | Fukui et al. | 336/110 |
| 5,450,755 | 9/1995 | Saito et al. | 336/200 |
| 5,551,146 | 9/1996 | Kawabata et al. | 336/83 |
| 5,559,487 | 9/1996 | Butcher et al. | 336/83 |
| 5,598,136 | 1/1997 | Kano et al. | 336/200 |
| 5,694,030 | 12/1997 | Sato et al. | 336/200 |
| 5,844,461 | 12/1998 | Faulk et al. | 336/206 |

FOREIGN PATENT DOCUMENTS

| | | | |
|---|---|---|---|
| 2409-881 | 4/1975 | European Pat. Off. | 336/83 |
| 1-51648 | 2/1989 | Japan . | |
| 4-142713 | 5/1992 | Japan | 336/177 |
| 4-151810 | 5/1992 | Japan | 336/232 |
| 4-215412 | 8/1992 | Japan | 336/177 |
| 8-84646 | 3/1994 | Japan | 336/177 |

OTHER PUBLICATIONS

*Journal Of The Magnetics Society Of Japan*, "Mechanism of Conductive Losses In A Sandwich–Structured Planar Inductor", Yamaguchi, et al. vol. 16, No. 2, (with translation) 1992, (No Month).

*Primary Examiner*—Lincoln Donovan
*Assistant Examiner*—Anh Mai
*Attorney, Agent, or Firm*—Brinks Hofer Gilson & Lione

[57] ABSTRACT

A plane transformer has both a primary plane coil and secondary plane coils fitted in a fitting groove formed on a substrate composed of a magnetic substance. At least either of the primary plane coil and the secondary plane coils is separated into two, so that an output voltage is variably controlled by changing the numbers of turns of the primary and secondary plane coils. The plane transformer can be small in size and thickness, reduces generated heat, and hardly emits electromagnetic noises.

20 Claims, 10 Drawing Sheets

PLANE TRANSFORMER

BACKGROUND OF THE INVENTION

1. Field of the Invention

The present invention relates to a plane transformer having a special shape capable of realizing a reduced size and thickness, which can be used in a power-supply circuit such as a DC-to-DC converter.

2. Description of the Related Art

These days, it is required that electronic apparatuses are smaller in size and thickness with the spread of portable information apparatuses. Accordingly, there is increasing demand that built-in power-supply circuits for such apparatuses be smaller in size and thickness. In particular, it is an important issue to reduce the size and thickness of magnetic devices such as transformers or inductors.

Conventionally, there are known transformers built in this type of electronic apparatuses, such as a transformer which has a toroidal core comprising a primary coil and a secondary coil formed around a magnetic core composed of a ring-shaped magnetic substance formed by winding amorphous alloy foil produced by a quenching method, and another transformer in which a magnetic core (EI type magnetic core) has a shape formed by combining an E type magnetic substance and an I type magnetic substance and the E type magnetic substance include a coil in its central portion.

With the reduction in the size and thickness of electronic apparatuses, there is demand that transformers having a height of several millimeters be used. However, in the transformer having the conventional toroidal core, the magnetic substance thinly formed causes its insufficient strength, which may constitute a problem of strength, and when a ring-shaped magnetic substance formed by winding foil, the width of foil which can be produced is limited, thus, the width of the foil limits the thickness of the ring-shaped magnetic substance, and disadvantageously, there is a certain limit in the decrease in the thickness of the ring-shaped magnetic substance, and the number of turns around the thin substrate is limited.

In the EI core type magnetic core obtained by combining the E type magnetic substance and the I type magnetic substance, the combination of the E type and I type magnetic substances requires a sufficient, overall thickness, and since the thickness of the coil is added, the overall thickness can hardly be set to several millimeters. Further, the conventional transformers and inductors which have exposed coils emit unnecessary high frequency electromagnetic fields, thereby generating electromagnetic noises and causing malfunctions of integrated circuits on the same mother board to which these transformers and inductors are mounted and malfunctions of other apparatuses and devices.

In either of the transformer having the toroidal core and the transformer having the EI core, the magnetic core is needed to be fitted in a resin bobbin. However, when the magnetic core is fitted in the resin bobbin with resin coating, the resin coat and the resin bobbin store heat generated inside the transformer, and cannot emit the heat to the exterior. Thus, disadvantageously, the whole magnetic core readily heats. In addition, the shape of the EI core causes problems of increased core loss due to the magnetic flux concentration and increased copper loss due to intersections of conductor lines and magnetic flux. Thus, defectively, the generated heat concentrates at a point, caused by the construction of the EI core.

SUMMARY OF THE INVENTION

The present invention has been made to eliminate the above problems. Accordingly, it is an object of the present invention to provide a plane transformer in which its construction is quite different from that of the conventional toroidal transformer, and core loss and generated heat are reduced and the generated heat is readily discharged by decreasing copper loss with uniform current distribution and eliminating the concentration of magnetic flux with a plane shape in deposition of built-in conductors, thus, the size and thickness of the transformer are easily discharged, and in which an output voltage can be readily changed by changing the numbers of turns of the primary and secondary coils, and operating magnetic flux is not leaked to the exterior with each coil surrounded by a magnetic substance so that electromagnetic noises are almost not emitted.

According to an aspect of the present invention, the foregoing object is achieved by the provision of a plane transformer in which a primary plane coil and secondary plane coils are fitted in a fitting groove formed on a substrate comprised of a magnetic substance, at least either of the primary plane coil and the secondary plane coils comprising a plurality of conductors, and an output voltage is variably controlled.

According to another aspect of the present invention, the foregoing object is achieved by the provision of a plane transformer including a plurality of substrates comprised of magnetic materials, a gap insulating layer provided between the substrates, a primary plane coil, a main-insulating layer, and secondary plane coils, the primary plane coil, the main-insulating layer and the secondary plane coils being fitted in the substrates, in which on one surface of at least one of the plurality of substrates a fitting groove having a shape fit for the overall shape of each plane coil is formed, and in the formed fitting groove the primary plane coil, the main-insulating layer and the secondary plane coils are fitted so as to be sequentially disposed so that the plurality of substrates are mutually incorporated by the gap insulating layer. In the plane transformer another substrate comprised of a plate-shaped magnetic substance, on which a fitting groove having a shape fit for the overall shape of each plane coil is formed, may be bonded to the substrate so that the fitting groove is closed. In the plane transformer the plane coils may be formed in the shape of a meander or vortex.

Preferably, the widths of the upper plane coil and the lower plane coil among the plane coils sequentially disposed in the fitting groove is shorter than the cross-sectional width of the middle plane coil.

In addition, the thickness of the gap insulating layer is preferably between 1 and 50 $\mu$m, and fitting grooves may formed on the plurality of substrates. In the plane transformers, with at least either of the primary plane coil and the secondary plane coils separated into two along a center line extending over its overall length, the separated primary plane coils or secondary plane coils may be mutually connected to form a continuous plane coil.

The width of the fitting groove is preferably between 0.2 and 2 $\mu$m, and the substrate preferably consists of a magnetic substance having a permeability of 200 or higher at 1 MHz. The main-insulating layer or a gap insulating layer disposed between the primary plane coil and the secondary plane coils preferably consist of one resin selected from the group of polyvinyl chloride, polystyrene, polypropylene, polyethylene, polycarbonate, polyester, fluororesin (polyethylene tetrafluoride), polyimide, polyethyleneterephthalate, nylon, and epoxy resin, and the plane coil may consist of two layers of foil composed of a conductive material and a resin film.

As described above, according to the present invention, the primary plane coil and the secondary plane coils are fitted in the fitting groove formed on the substrate comprised of a magnetic substance, and either of the primary plane coil and the secondary plane coils is plurally separated. This arrangement makes it possible to change the number of the primary coil turns and the number of the secondary coil turns, which thus enables a plane transformer in which an output voltage can be set to a desired ratio.

On the other hand, the primary plane coil and the secondary plane coils can be fitted in the substrate comprised of a magnetic substance, and a magnetic substance having high permeability can be disposed in proximity to the primary plane coil and the secondary plane coils. In addition, inductance in the periphery of each plane coil can be increased, and when a current is supplied a current density in the plane coil conductor can be uniformly formed. Such an arrangement enables a plane transformer in which heat caused by Joule effect is less generated in the plane coil portion. Further, the arrangement in which the primary plane coil, the secondary plane coils and the main-insulating layer provides a characteristic in which the whole of the transformer can be small-sized and have a reduced thickness. Consequently, by using the present invention to a power supply such as a DC-to-DC converter, the option of circuit design can be improved and a small-sized, highly efficient power supply circuit can be provided.

According to the present invention, the fitting groove in which the plane coils and the main-insulating layer are fitted is formed on at least one of a plurality of substrates, and the gap insulating layer is provided between the substrates. Such an arrangement enables uniform magnetic flux distribution on one substrate and another substrate by increasing magnetic resistance in the gap insulating layer, and enables magnetic flux generated by the primary plane coil and the secondary plane coils to be homogenized so that concentration of the magnetic flux on one portion of the plane coil can be suppressed, which prevents excessive local heat generated in the plane coil. Thus, it is possible to provide a thermally-efficient plane transformer which does not have a possibility in which the plane coil is melted by heat. As a whole, possible core loss in a plurality of substrates can be reduced.

In addition, by comparing the arrangement in which the primary plane coil and the secondary plane coils are fitted in the magnetic substrate with the conventional arrangement in which coils are fitted in a bobbin, it is found that even when heat is generated in the plane coil the heat can be discharged through the substrate because the substrate covering the bobbin has thermal conductivity higher than that of the resin bobbin. Therefore, a plane transformer which hardly stores heat can be provided.

According to the present invention, the length of the plane coil determines a maximum of output, thus, by forming the plane coil in the shape of a meander or spiral, highest output can be obtained when even a thin, small-sized substrate is used.

In addition, by forming the cross-section widths of the upper plane coil and the lower plane coil to be smaller than the cross-sectional width of the middle plane coil, the magnetic flux generated by the plane coils can hardly be received as interlinked magnetic flux by ends of the upper plane coil and the lower plane coil, so that heat generated at the ends can be reduced.

According to the present invention, by separating at least either of the primary plane coil and the secondary plane coils along a center line extending over its overall length, and by connecting the separated plane coils in series, the turn ratio of the primary plane coil and the turn ratio of the secondary plane coils can be changed. This enables a plane transformer having different output voltage ratios. In addition, by stacking at least either a plurality of primary plane coils or a plurality of secondary coils, a plane transformer having more different output voltage ratios is realized.

Also, by forming the gap insulating layer so as to have a thickness of 1 to 50 $\mu$m, the concentration of magnetic flux in proximity to a coil in which an exciting current flows is suppressed, thus, the locally generated heat due to core loss can be advantageously prevented.

Further, by forming the fitting groove so as to have a width of 0.2 to 2 mm, a plane transformer in which a decrease in the coupling coefficient can be suppressed and the transformation efficiency is improved is realized. In addition, by setting the permeability of the magnetic substance forming the substrate to 200 or higher at 1 MHz, the inductance of the periphery of the plane coil can be firmly increased and the current density in the plane coil can be uniformly formed, thus, heat caused by Joule effect in the plane coil can be firmly reduced.

DESCRIPTION OF THE PREFERRED EMBODIMENTS

By referring to the attached drawings, embodiments of the present invention will be described below.

Figure 1:
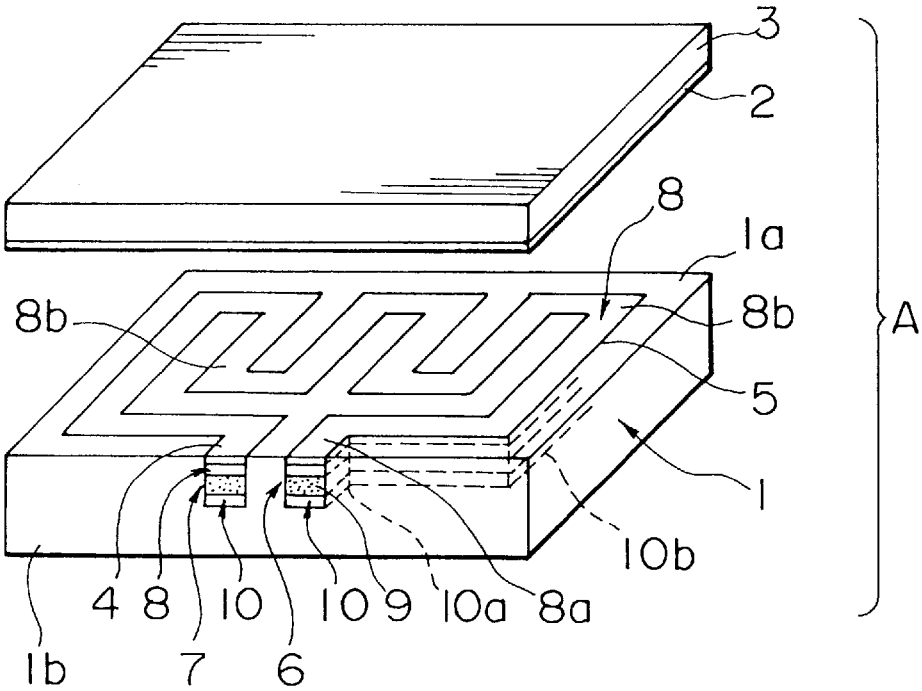
FIG. 1 is an exploded perspective view illustrating a plane transformer according to a first embodiment of the present invention.
Figure 2:
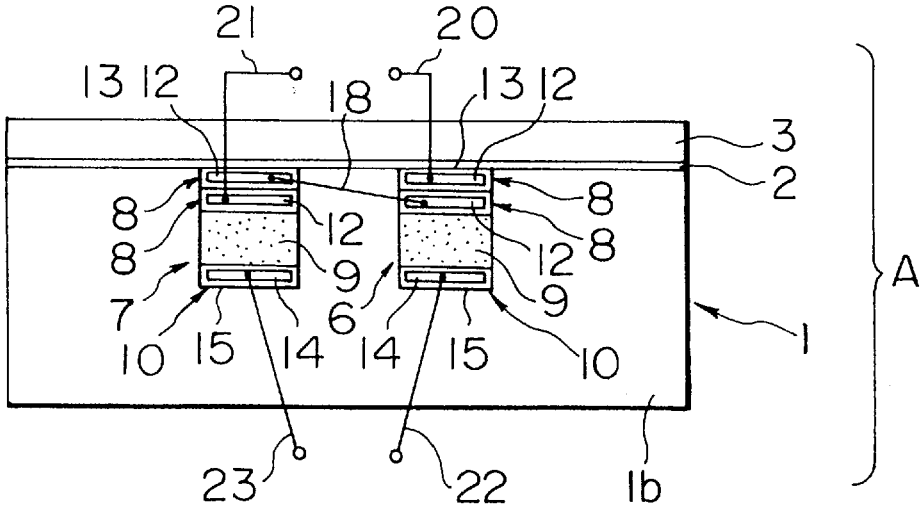
FIG. 2 is a side view illustrating the plane transformer according to the first embodiment of the present invention.
Figure 3:
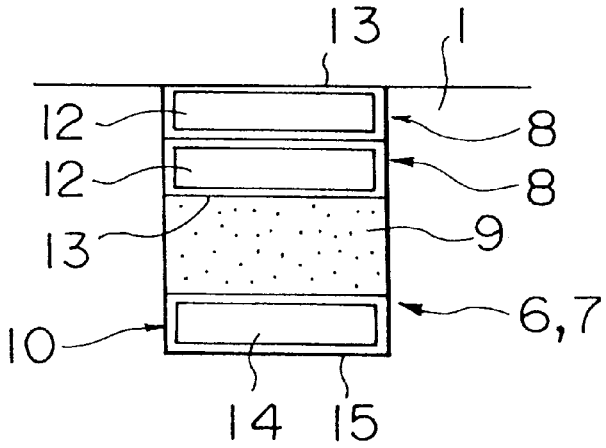
FIG. 3 is a partially enlarged view illustrating the plane transformer shown in FIG. 2.

FIGS. 1 to 3 illustrate a plane transformer according to a first embodiment of the present invention. The plane transformer A, according to the embodiment, chiefly includes a substrate 1 comprised of a plate-shaped magnetic substance in which a plane coil (mentioned below) is fitted, a gap insulating layer 2 bonded to the upper surface of the substrate 1, and a plane substrate 3 comprised of a magnetic substance bonded to the gap insulating layer 2. The magnetic substances forming both substrates 1 and 3 are comprised of a magnetic substance which has high electric resistance and high permeability, such as Ni—Zn ferrite or Mn—Zn ferrite. The gap insulating layer 2 is comprised of an insulating resin film.

It is preferable to use a magnetic substance having a permeability of 200 or higher at 1 MHz as the magnetic substances forming the substrates 1 and 3, and it is more preferable to use a magnetic substance having permeability of 1000 or higher at 1 MHz. This construction is to prevent locally generated heat by increasing the inductance of the periphery of the plane coil in disposition of a highly permeable magnetic substance in proximity to the plane coil (as mentioned below) so that the current density in the plane coil becomes uniform. However, this arrangement is undesirable because the low permeability of the substrates 1 and 3 causes a large portion of the plane coil to heat.

In addition, the use of a magnetic substance having high electric resistance and high permeability (such as Ni—Zn ferrite or Mn—Zn ferrite) as the substrate 1 or 3 enables efficient discharge of heat that is generated in the plane coil or the substrate 1 or 3 to the exterior because the magnetic substance has superior thermal conductivity.

The fitting groove 5 is formed in the shape of a meander on an upper surface 1*a* of the substrate 1 so as to have openings on the upper surface 1*a* and a side surface 1*b* of the substrate 1.

The fitting groove 5 in this embodiment has short linear portions extending from an entrance portion 6 and an exit portion 7, and has other portions which are formed in the shape of a meander or comb-teeth. More precisely, the fitting groove 5 is formed so as to expose the entrance portion 6 and the exit portion 7 from the upper surface 1*a* and the side surface 1*b* and to expose the meander-shaped portion extending from the entrance portion 6 to the exit portion 7 from the upper surface 1*a* of the substrate 1 so that the meander-shaped portion intersects as little as possible the upper surface 1*a* of the substrate 1.

According to the embodiment shown in FIGS. 1 and 2, the fitting groove 5 is formed in the shape of a plane meander, however, it may be formed in a different shape if the shape is another plane shape such as a spiral or saw edge, and the portion extending from the entrance portion 6 to the exit portion 7 does not intersect an area of its extension.

Preferably, the width of the fitting groove 5 is between 0.2 and 2 mm, and more preferably, between 0.4 and 2 mm. These relationships are determined from the relationship between a coupling coefficient and a conductor width, which is mentioned below. When the width of the fitting groove 5 decreases to less than 0.4 mm, the decrease in the coupling coefficient tends to be fairly large, and when the width decreases to less than 0.2 mm, the decrease in the coupling coefficient is huge. Thus, such a range is preferred.

In the fitting groove 5, secondary plane coils 8, a main insulating layer 9, and a primary plane coil 10 (which all have the same plane shape as the fitting groove 5) are fitted from the top in the order given so as to be sequentially disposed. The secondary plane coil 8 is obtained by forming an insulating resin film 13 on the periphery of a film conductor 12 comprised of a conductive material such as copper, while the primary plane coil 10 is similarly obtained by forming an insulating resin film 15 on the periphery of a film conductor 14 comprised of a conductive material such as copper. The respective coils 8 and 10 include short linear portions 8*a* and 10*a* which are fitted in the entrance portion 6 and the exit portion 7 of the fitting groove 5, and bending portions 8*b* and 10*b* in the shape of a meander or comb-teeth which are continuous to the linear portions 8*a* and 10*a*.

Preferably, the thickness of the film conductor 12 or 14 is between 5 and 100 μm and the cross-sectional width is between 0.3 and 2 mm, and more preferably, the thickness is between 35 and 100 μm.

This is because, a skin depth determined by a current at 1 MHz is approximately 66 μm, and even when the thickness of the film conductor 12 or 14 is increased more than necessary, d.c. (direct current) resistance can be reduced, but a.c. (alternating current) resistance does not decrease, the coupling coefficient decreases, and a successive decrease in the thickness o the film conductor 12 or 14 causes d.c. resistance to greatly increase. Accordingly, the thickness of the film conductor 12 or 14 for enabling low d.c. resistance and a preferred coupling should be 35 μm. Thus, the thickness of the film conductor 12 or 14 is preferably between 5 and 100 m, and more preferably between 35 and 100 μm. The cross-sectional width is preferably between 0.3 and 2 mm.

It is undesirable that the film conductor 12 or 14 have a thickness of 5 μm or lower because copper foil having a uniform thickness set to the above thickness can hardly be produced with production technology. By increasing the thickness of the film conductor to more than 100 μm, d.c. resistance can be reduced, but the coupling coefficient deteriorates as described above. For example, rather than using one film conductor having a thickness of 200 μm, by connecting two stacked film conductors having a thickness of 100 μm in parallel so that the total thickness of the film conductors is set equally to 200 μm, heat generated in the film conductors into which the same amount of current is supplied at 1 to 10 MHz can be greatly reduced. This is because the arrangement in which a plurality of stacked film conductors are connected in parallel can reduce the generated heat, compared with the arrangement of a single film conductor in view of the skin depth effect. Therefore, the former is more effective.

In practical use, the output voltage ratio of the primary and the secondary determines the number of sequentially disposed film conductors, and the thickness of the substrate 1 to be used determines the depth of the fitting groove 5. Therefore, in accordance with the determined values, it is also necessary to properly select a thickness needed for the film conductor. Consequently, for example, when primary:secondary=1:2 (turns), the thickness of the film conductor 14 of the primary plane coil 10 can be set to 70 μm, and the thickness of the film conductor 12 of the secondary plane coil 8 can be set to 35 μm.

The insulating gap layer 2 and the main-insulating layer 9 are comprised of insulating films such as a resin film. The main-insulating layer 9 is preferably 0.4 mm thick or greater based on the safety standard (such as IEC950) required for the primary and secondary coils for this type of thin plane coil. The thickness of the gap insulating layer 2 is preferably between 1 and 50 μm, more preferably between 1 and 10 μm, and within these ranges the most preferable thickness is 5 μm.

In the above-described arrangement the gap has effects which reduce core loss due to a uniform magnetic density (cf. I. Sasada, et al., IEEE Trans. Magn. vol. 29, No. 6, pp. 3231, 3233). It is undesirable that the gap insulating layer 2 have a thickness of 1 μm of lower because the gap insulating layer 2 having this thickness can hardly be produced. It is also undesirable that the gap insulating layer 2 has a thickness of 50 μm or greater because the coupling coefficient deteriorates at the thickness. In addition, the most preferable thickness for the gap insulating layer 2 is 5 μm because a high coupling coefficient, and uniform magnetic flux densities in proximity to the film conductors 12 and 14 are obtained.

The gap insulating layer 2 and the main-insulating layer 9 are preferably comprised of resins which have small dielectric constants. Definitely, a type of resin can be properly selected for use from polyimide, polyvinyl chloride, polystyrene, polypropylene, polyethylene, polycarbonate, polyester, polyethylene tetrafluoride, fluororesin, polyimide resin, polyethyleneterephthalate, tetrafluoroethylene, nylon, and epoxy resin. These resins have sufficiently low dielectric constants between 2 and 4, which thus can be applied to the present invention.

More definitely, at $10^3$ to $10^9$ Hz, polyvinyl chloride has a dielectric constant of 2.8 to 3.3, polystyrene has a dielectric constant of 2.4 to 2.7, polypropylene has a dielectric constant of 2.0 to 2.1, polyethylene has a dielectric constant of 2.3, polycarbonate has a dielectric constant of 2.94 to 2.99, polyester has a dielectric constant of 2.8 to 3.2, polyethylene tetrafluoride has a dielectric constant of 2.0 to 2.1, tetrafluoroethylene has a dielectric constant of 2.0 to 2.1, and at $10^3$ Hz, polyimide has a dielectric constant of 3.62 and polyethyleneterephthalate has a dielectric constant of 2.6. Thus, each resin has a sufficiently low dielectric constant of 2 to 4, which can be applied to the present invention.

End portions of the secondary plane coils 8 and the primary plane coil 10, which are positioned at the entrance portion 6 and the exit portion 7, have no resin insulating films 13 and 15, and have exposed film conductors made of conductive materials. The film conductor 12 of the lower secondary plane coil 8 in the entrance portion 7 and the film conductor 12 of the upper secondary plane coil 8 in the exit portion 7 are electrically connected by a connecting line 18. A lead 20 is connected to the film conductor 12 of the upper secondary plane coil in the entrance portion 6. A lead 21 is connected to the film conductor 12 of the lower secondary plane coil in the exit portion 7. A lead 22 is connected to the film conductor 14 of the primary plane coil 10 in the entrance portion 6. A lead 23 is connected to the film conductor 14 of the primary plane coil 10 in the exit portion 7. The leads 20 and 21 form the second terminals in the second coil, and the leads 22 and 23 form the first terminals in the first coil.

The plane transformer A uses the leads 22 and 23 for the primary and the leads 20 and 21 for the secondary, and thus functions as a transformer with an output ratio of 1:2.

In this embodiment the primary plane coil 10 and the secondary plane coil 8 are oppositely disposed up and down. Thus, by increasing the length of the coil pattern, the maximum output can be proportionally increased. Each coil is formed in the shape of a meander or comb-teeth in its bending portion 8*b* or 10*b* so as to have a maximum length, and this arrangement can sufficiently increase the maximum output.

When a current is supplied to a flat, rectangular conductor in general, the periphery farthest from the center on the conductor cross section has a high current density and other portions have low current densities, which causes large a.c. resistance in the conductor to generate heat. Also, in order to flatten the polarization of a high frequency current in the flat, rectangular conductor, it is preferable to provide a highly permeable magnetic material in proximity to the end surface having a high current density (cf. Yamaguchi, Sasada, Harada, Journal of the Magnetic Society of Japan 16, pp. 445–448, 1992). According to the present invention, magnetic materials which have high permeability of 200 or higher at 1 MHz and preferably 1000 or higher are disposed around the primary plane coil 10 and the secondary plane coil 8. This arrangement can reduce partially generated heat in each plane coil.

In this embodiment the substrate 1, comprised of a magnetic substance which has high electric resistance and high permeability such as Ni—Zn ferrite and Mn—Zn ferrite, is superior in thermal conductivity, and can dispose each plane coil and the magnetic substance in close proximity to each other on a wide area, so that the heat generated in the plane coil can be speedily discharged to the exterior through the substrate 1, and it is therefore less possible that the plane coil accumulates heat, different from a conventional transformer that receives a resin bobbin.

Since both the secondary plane coil 8 and the primary plane coil 10 can be formed in a sheet so as to have a reduced thickness, the plane transformer A which has a total thickness of several millimeters is formed. Even when the transformer A is provided with the fitting groove 5 having a depth of approximately several millimeters, a plurality of sheet-formed plane coils such as the coils 8 and 10 can be readily, stacked, and the combination of stacked coils can set the output ratio of the primary plane coil and the secondary plane coil to 1:n, different from the ratio of 1:2 used in this embodiment. In other words, for example, by stacking three sheet-formed secondary plane coils and connecting them in series with a connecting line, an output ratio of 1:3 can be obtained, and by stacking four sheet-formed secondary plane coils and connecting them in series with a connecting line, an output ratio of 1:4 can be obtained.

From the comparison between the plane transformer provided with a gap and the plane transformer that is not provided-with a gap, according to the present invention, it is considered that the plane transformer that is not provided with the gap insulating layer 2 slightly has superior coupling and efficiency. However, the plane transformer that is not provided with the gap insulating layer 2 forms a closed magnetic circuit, thus, magnetic flux concentrates around a coil where an exciting current is present, and such a phenomenon causes a problem of heat caused by partial magnetic saturation and concentration of core loss. Accordingly, it is considered to use the plane transformer provided with the gap. In other words, since the gap insulating layer 2 has high magnetic resistance, magnetic density distribution in the substrates 1 and 3 comprised of the magnetic substance is uniform.

Although the coupling coefficient is reduced by providing the gap, research made by the present inventors shows that the coupling coefficient slightly decreases as the gap set to 5 $\mu$m causes a coupling coefficient of 0.985 and the gap set to 20 $\mu$m causes a coupling coefficient of 0.95. To the contrary, in the transformer provided with the gap, magnetic density distribution in the magnetic substance is effectively uniform. For example, in the plane transformer that is not provided with the gap the central portion of the magnetic substance has a magnetic flux density three times or greater that of one end of the magnetic substance, however, by setting the gap to 5 $\mu$m, the magnetic flux distribution is almost flat. Consequently, for decreasing the size of the plane transformer, it is important to eliminate a portion having a saturated magnetic flux density by uniform magnetic flux density of the plane transformer.

By referring to FIGS. 4 to 6, a method for producing the above-described plane transformer A according to one embodiment of the present invention will be described below.

Figure 4:
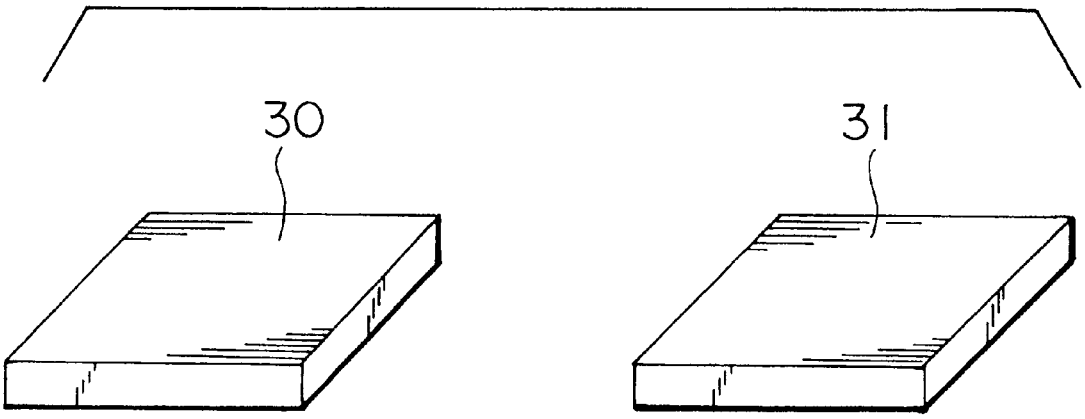
FIG. 4 is a perspective view illustrating one substrate and another substrate which are used in a method for producing a plane transformer according to the present invention.
Figure 5:
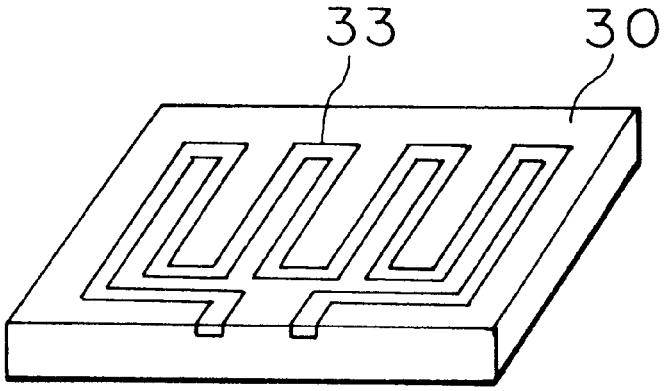
FIG. 5 is a perspective view illustrating each substrate (shown in FIG. 4) on which a fitting groove is formed.

In order to produce the plane transformer A according to the embodiment, substrates 30 and 31 (as shown in FIG. 4) comprised of a high permeable material such as Ni—Zn ferrite are prepared, and on the upper surface of the plate substrate 30, a fitting groove 33 which has a meander shape and a depth of approximately one-several-th mm as shown in FIG. 5 is formed by means such as ultrasonic machining. Subsequently, by punching a plural types of resin films with copper foil in which copper foil having a thickness of approximately several tens $\mu$m is incorporated, resin film with copper foil 35 which has a similar shape as the fitting groove and can be inserted into the fitting groove as shown in FIG. 6 is formed. The resin film with copper foil 35 is coated with resin film such that the side surface of the resin film with copper foil 35 is coated with resin by dipping and is dried.

Subsequently, by punching an insulating sheet with a similar shape as the fitting groove, a main-insulating layer is formed. In order to form the main-insulating layer, a method in which resin powder is pressed to form a sheet may be employed.

The coil 35 and the main-insulating layer, obtained in the previous process, are formed in the order given in the fitting groove 33 of the plate substrate 30, and the substrate 31 is disposed and bonded thereto with a resin sheet which has a thickness of several micrometer to several tens micrometers provided therebetween, thereby a plane coil similar to that in the plane transformer A can be obtained.

In connection with ends of the coil with copper foil which are exposed from openings of a side of the substrate, the copper portions of the coil are exposed by removing the resin film using proper means so that ends of plurally separated plane coils are mutually connected. If necessary, with the ends connected after the removal of the resin film, the whole of the plane transformer may be finished by coating it with thin resin.

Figure 7:
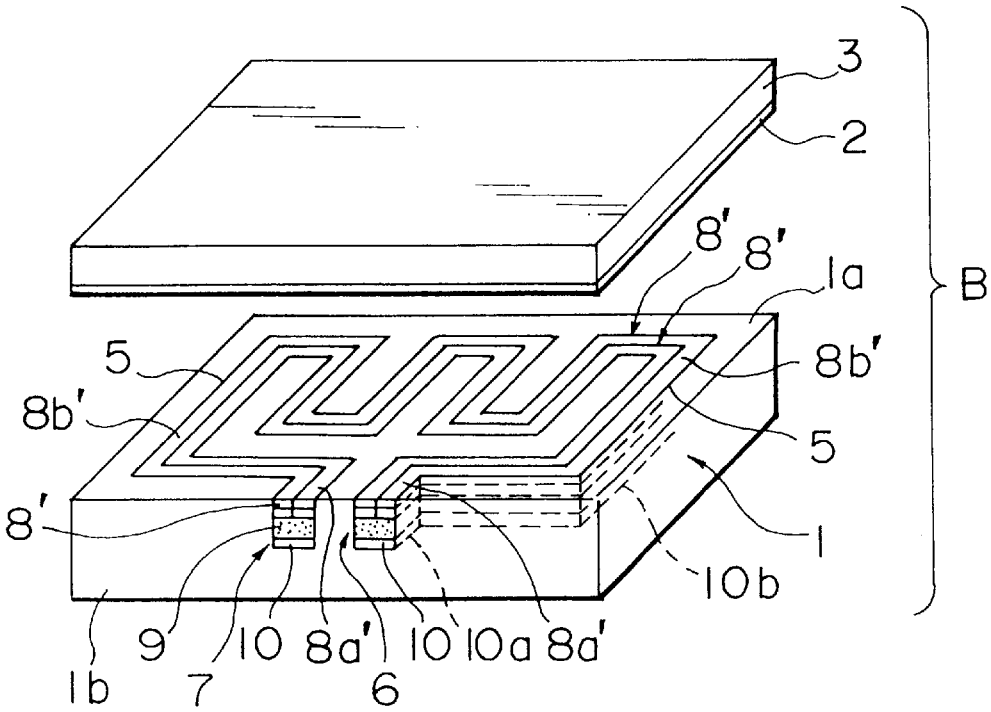
FIG. 7 is an exploded perspective view illustrating a plane transformer according to a second embodiment of the present invention.
Figure 8:
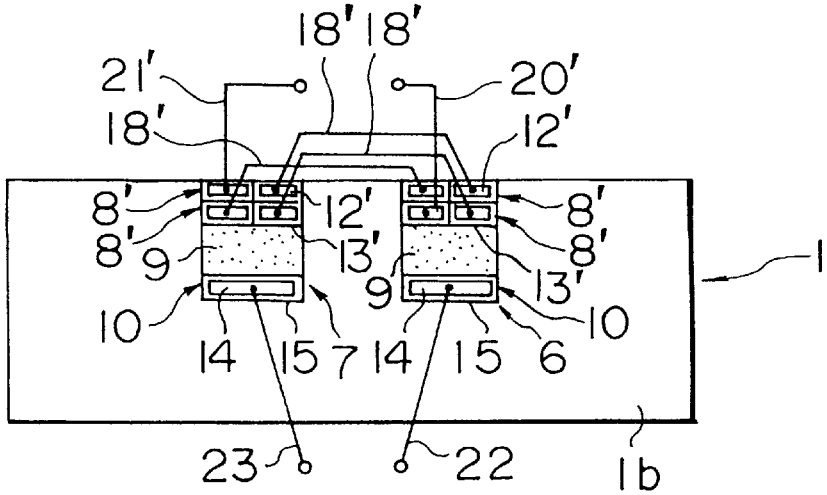
FIG. 8 is a side view illustrating the plane transformer according to the second embodiment of the present invention.

FIGS. 7 and 8 illustrate a plane transformer according to a second embodiment of the present invention. This plane transformer B according to the second embodiment differs from the plane transformer A according to the first embodiment in the shape of the secondary coil.

In the plane transformer B, secondary plane coils 8' have linear portions 8*a*' and bending portions 8*b*' as same as the primary plane coil 8 according to the first embodiment, and is formed in the shape of a meander or comb-teeth as a whole. However, the secondary coils 8' differ from the primary plane coil 8 in the following points: the cross section of each secondary plane coil 8' is formed so as to have a half width of that of the first secondary plane coil 8, a total of four secondary plane coils 8' are fitted into the fitting groove 5, and the respective secondary coils 8' are connected in series by three connecting lines 18'. In other words, according to the second embodiment, the secondary plane coils 8' which have a shape in which the secondary plane coil 8 according to the first embodiment is separated into two by a center line extending over its overall length are combined and fitted into the fitting groove 5, and are connected in series to form a continuous plane coil.

Other portions of the plane transformer are similar to those in the plane transformer according to the second embodiment. Accordingly, with them denoted by the same reference numerals, detail descriptions of them will be omitted.

The plane transformer B according to the second embodiment is provided with four secondary plane coils 8', and thus enables an output ratio of 1:4.

Other operations and advantages are equivalent to the second embodiment.

Figure 9:
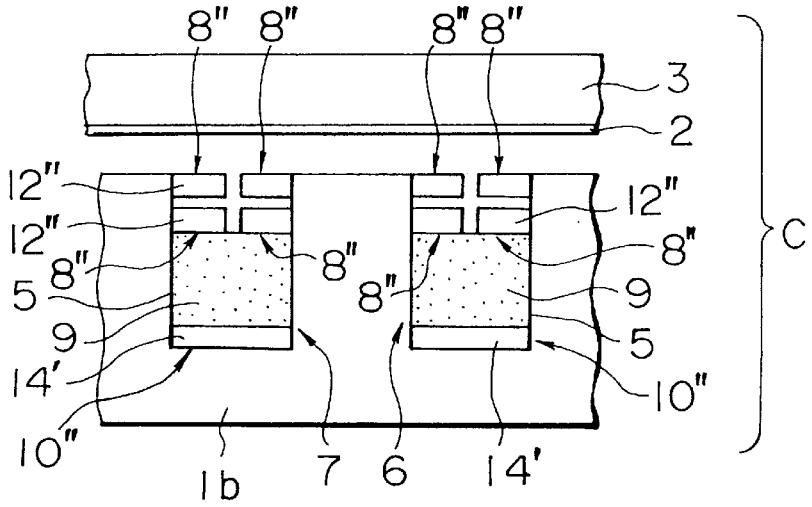
FIG. 9 is an exploded perspective view illustrating a plane transformer according to a third embodiment of the present invention.

By referring to FIG. 9 that illustrates a plane transformer according to a third embodiment of the present invention, the plane transformer C differs from the plane transformer B according to the first embodiment in the shapes of the primary plane coil and the second plane coil and the arrangement of thereof.

According to the third embodiment, secondary plane coils 8" are comprised of film conductors 12" made of a conductive material. The primary plane coil 10" is comprised of a film conductor 14' made of a conductive material. Each coil is not coated with resin. The secondary plane coils 8" are fitted into a fitting groove 5 with appropriate distances provided, and the primary plane coil 10" is fitted in the bottom of the fitting groove 5 with an appropriate distance provided with respect to the secondary plane coils 8.

The respective coils 8" and 14' according to this embodiment are adhesively fixed to an interior surface of the fitting groove 5 shown in FIG. 9.

Other portions are similar to those in the plane transformer B according to the second embodiment.

According to the third embodiment, each coil is not coated with resin, however, an air layer that is present between the coils has the insulating function, and thus functions as an insulating layer. Accordingly, the arrangement of the coils in this embodiment also enables operations and advantages similar to those in the plane transformer B.

Figure 10:
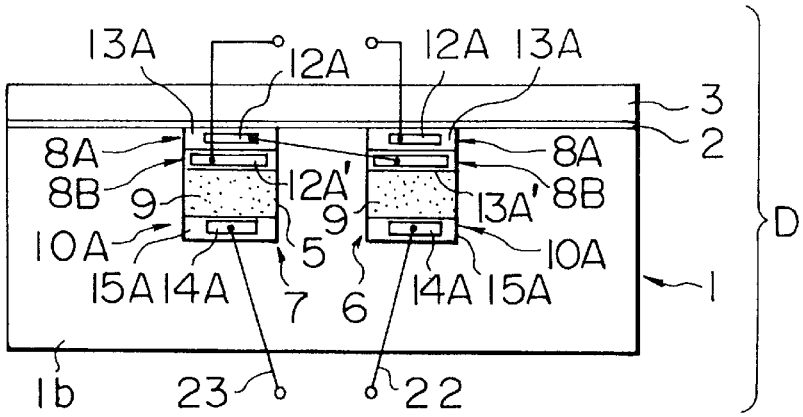
FIG. 10 is an exploded perspective view illustrating a plane transformer according to a fourth embodiment of the present invention.
Figure 11:
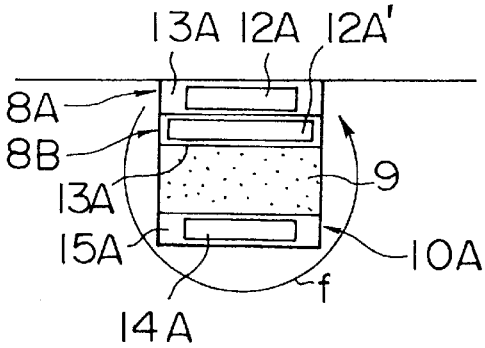
FIG. 11 is a side view illustrating the position of magnetic flux in the plane transformer according to the fourth embodiment.

By referring to FIGS. 10 and 11 which illustrate a plane transformer according to a fourth embodiment of the present invention, the plane transformer D differs from the plane transformer A according to the first embodiment in the shapes of the primary plane coil and the secondary plane coil.

In a fitting groove 5, an uppermost secondary plane coil 8A is comprised of a film conductor 12A made of a conductive material, and a coating layer 13A wrapping a film conductor 12A up. A secondary plane coil 8B in the middle is comprised of a film conductor 12A' and a coating layer 13A' wrapping a film conductor 12A' up. The width of the uppermost secondary plane coil 8A in the cross section of the film conductor 12A is formed narrower than that of the film conductor 12A' of the middle secondary plane coil 8B. Also, a lowermost primary plane coil 10A is comprised of a film conductor 14A made of a conductive material, and coating layer 15A wrapping a film conductor 14A up. The film conductor 14A of the primary plane coil 10A is formed so that its width is narrower than that of the film conductor 12A' of the middle secondary coil 8B, similar to the case of the uppermost secondary plane coil 8A.

The cross-sectional width of the uppermost film conductor 12A and the cross-sectional width of the lowermost film conductor 14A are formed narrower than that of the middle film conductor 12A' because, according to the fourth embodiment, when a current is supplied, magnetic flux is generated so as to surround the primary plane coil 10A and the secondary plane coils 8A and 8B in the shape of a ring as denoted by arrow f shown in FIG. 11, and this condition allows the magnetic flux f to easily penetrate ends of the film conductors 12A and 14A. Consequently, in particular, by forming the film conductors 12A and 14A narrower than the film conductor 12A', the magnetic flux f hardly penetrates the film conductors 12A and 14A, and the flux f reduces interlinkages which penetrate the film conductors 12A, 12A' and 14A as much as possible, thereby, eddy current loss generated in the conductors is suppressed. For designing the structure of a transformer, it is required that the magnetic flux f should have efficient interlinkages through the magnetic substance and the flux f should not penetrate the film conductors 12A, 12A' and 14A. In the former case, efficiency is increased by providing the gap to the magnetic substance as described above. In the latter case, a reduction in the magnetic flux which penetrates the film conductors 12A, 12A' and 14A is realized by narrowing the widths of the film conductors 12 and 14A of the primary plane coil 8A and the secondary plane coil 10A which are stacked. Detailed description of the latter case is as follows:

the magnetic flux which penetrates the conductors can be reduced by narrowing the width of the film conductor 14A of the primary plane coil 10A an d the width of the film conductor 12A of the secondary plane coil 8A, which are shown in FIG. 11, and copper loss can be reduced by suppressing eddy current loss generated in the film conductors 12A and 14A.

Other operations and advantages are similar to those in the first embodiment.

Figure 12:
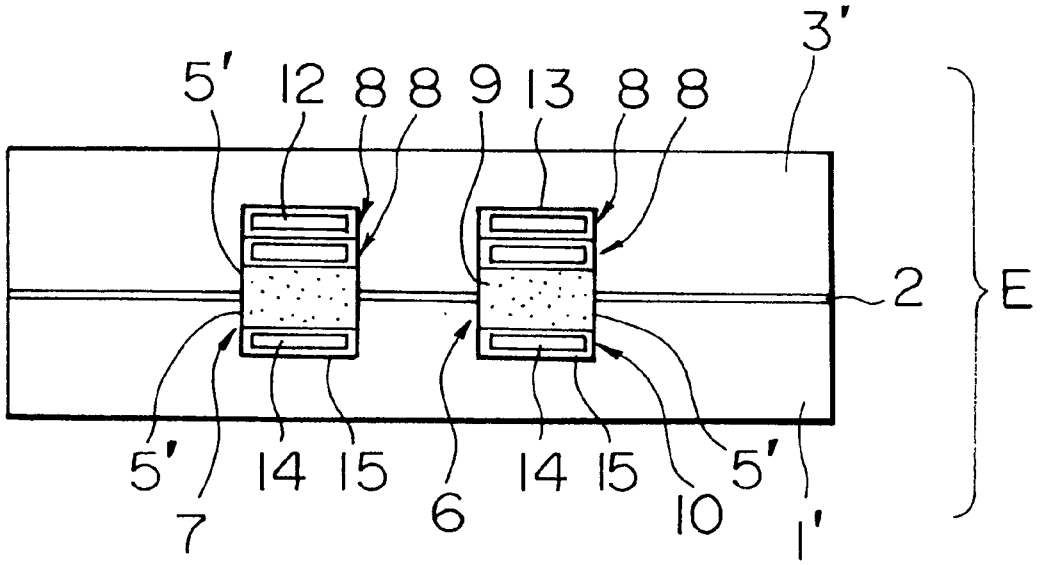
FIG. 12 is an exploded perspective view illustrating a plane transformer according to a fifth embodiment of the present invention.

By referring to FIG. 12 which illustrates a plane transformer according to a fifth embodiment of the present invention, the plane transformer E differs from the plane transformer A according to the first embodiment in the shapes of a substrate 1' and a substrate 3'.

On the substrates 3' and 3' according to the fifth embodiment, fitting grooves 5' which have a plane, similar shape as the fitting groove 5 of the plane transformer A according to the first embodiment and a half depth of that of transformer A are formed. In the fitting groove 5' of the substrate 3', two secondary plane coils 8 and the upper half of a main-insulating layer 9 are fitted, while, in the fitting groove 5' of the substrate 1', the lower half of the main-insulating layer 9 and a primary plane coil 10 are fitted. This arrangement may be modified as follows: The primary plane coil 10, the secondary plane coils 8, and the upper half of the main-insulating layer 9 are fitted in the substrate 3' and the fitting groove 5', and the lower half of the main-insulating layer 9 and the secondary plane coils 8 are fitted in the fitting groove 5' of the substrate 1'. The arrangement of other portions is similar to the plane transformer A according to the first embodiment.

Operations and advantages similar to those of the above-described plane transformer A according to the first embodiment can be obtained by also the arrangement in which the secondary coils 8, the main-insulating layer 9, and the primary plane coil 10 are fitted in the fitting grooves 5' formed on the substrates 1' and 3' as described in this embodiment.

It hardly need be said that the depths of the fitting grooves 5' formed on the substrates 1' and 3' do not need to be the same, but may be formed different as one depth is deeper and another depth is shallower.

The above-described plane transformers A to E have a two-layer structure of the substrates 1 and 3, but may has a multi-layer structure, namely, a three or more-layer structure. This multi-layer structure provides equivalent advantages similar to the case of the two-layer structure. In addition, the primary may be formed so as to have a multi-layer structure and the secondary may have a single-layer structure.

Figure 13:
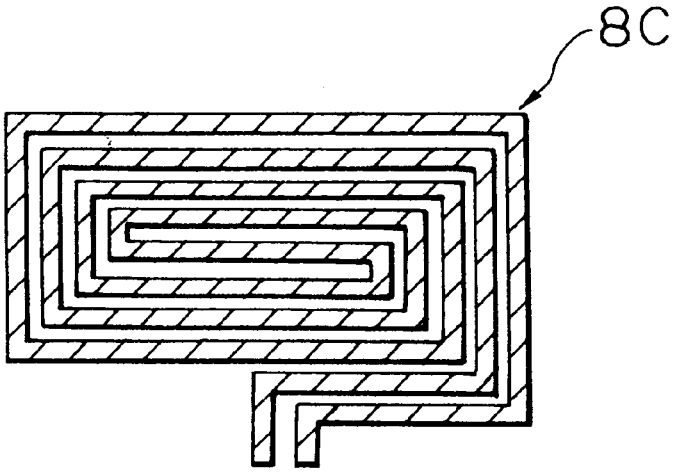
FIG. 13 is a plan view illustrating another example of the plane coil according to the present invention.

FIG. 13 illustrates another example of a secondary plane coil used in the present invention. This secondary plane coil 8C is formed so as to be plane, almost rectangular, double-spiral shaped.

Even the shape of the secondary plane coil 8C can provide similar advantages similar to the former embodiments. In addition, when the secondary plane coil 8C is formed in the shape shown in FIG. 13, it hardly need be said that the primary plane coil is formed in a similar shape.

As apparent in this example, the shape of the plane coil according to the present invention is not limited to the above-mentioned shape of a meander, but other shapes such as a plane shape, a circular shape, a double-spiral shape, the shape of a plane saw edge, and another shape may be used. In other words, an optional shape can be utilized if the shape allows a coil pattern to extend to its maximum length.

EXAMPLES

A substrate plate which is made of Mn—Zn ferrite, is 15 mm wide, 15 mm long and 1.6 mm thick, and a substrate plate which is made of Mn—Zn ferrite, is 15 mm wide, 15 mm long and 1.0 mm thick were prepared. A fitting groove was formed on the substrate plate of 1.6 mm thick by ultrasonic machining, in which the formed groove was 0.6 mm deep and measurements of other portions were shown in FIG. 14, so that a substrate was obtained.

Figure 6:
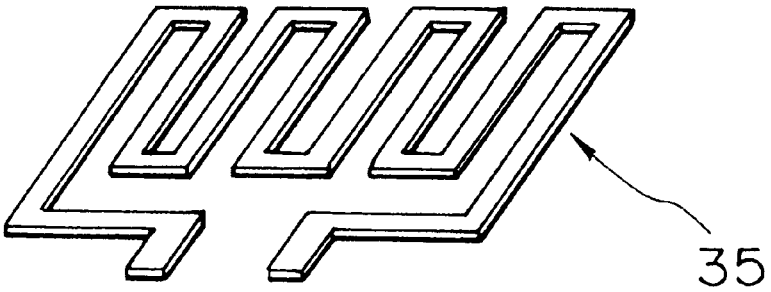
FIG. 6 is a perspective view illustrating an example of a coil to be fitted in the fitting groove shown in FIG. 5.

Subsequently, by punching a plurality of copper-coated films (approximately 60 to 100 $\mu$m thick, copper foil is 35 $\mu$m thick and 70 $\mu$m thick, and resin film is 25 $\mu$m), a primary plane coil and secondary plane coils which have a shape as shown in FIG. 6 were formed. By dipping the formed coils, the sides of the coils were coated with resin having a thickness of approximately 10 $\mu$m. Also in another process, by punching a resin sheet (of polyimide named "Kapton" (trademark) produced by Du Pont) having a thickness of 0.4 mm so as to have the same shape as the primary plane coil or the secondary plane coil, a resin film for a main-insulating layer was obtained.

The primary plane coil and the secondary plane coils were sequentially disposed to be fitted in the fitting groove of the substrate, and the substrate plate was bonded to the substrate by resin with a resin sheet (having a thickness of 2 to 50 $\mu$m) provided therebetween, so that a plane coil was produced. Successively, exposed ends of the secondary plane coils from one side of the substrate having the fitting groove were connected in series by a connecting line, and leads were connected to the remaining ends of the secondary plane coils and ends of the primary plane coil. Finally, the whole substrate was coated with a resin to produce a plane transformer.

The result of simulation in which the above-formed transformer was analyzed by considering the plane coil pattern as an optional shape are shown below. The results were obtained when the width $W_c$ of the fitting groove was set to values as shown in the following Table 1. Table 1 and FIG. 15 show coupling coefficients obtained when an operating frequency was set to 1 MHz and a characteristic of the magnetic substance (Ni—Zn ferrite) forming the substrate was set as $\mu$=1000 (tanδ=1).

TABLE 1

| $W_c$ [mm] | k | $W_c$ [mm] | k | $W_c$ [mm] | k |
|---|---|---|---|---|---|
| 0.100 | 0.9431 | 0.300 | 0.9796 | 0.700 | 0.9908 |
| 0.150 | 0.9608 | 0.400 | 0.9845 | 0.800 | 0.9919 |
| 0.200 | 0.9701 | 0.500 | 0.9874 | 0.900 | 0.9927 |
| 0.250 | 0.9758 | 0.600 | 0.9894 | 1.000 | 0.9934 |

Figure 15:
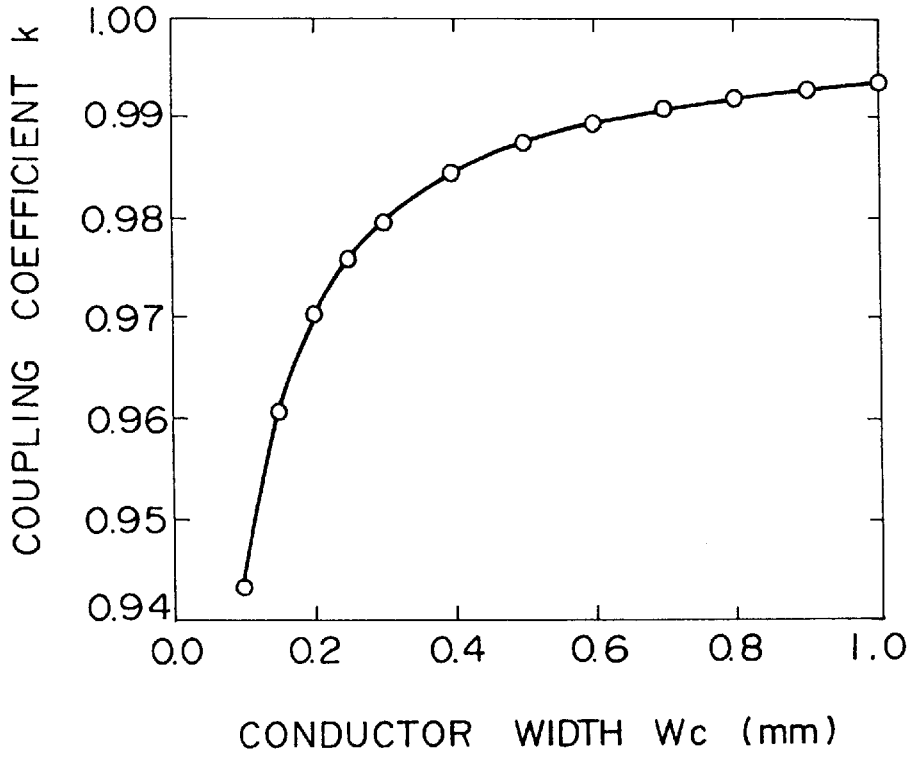
FIG. 15 is a graph showing the relationship between the conductor width and coupling coefficient of the plane transformer according to the example.

From the results shown in Table 1 and FIG. 15, it is apparent that, when the gap (the thickness of the insulating layer) between the substrate having the fitting groove and the substrate plate is 5 $\mu$m, the coupling coefficient begins to decrease at the groove width $W_c$ of less than 0.400 mm, and it rapidly decreases (the coupling coefficient becomes less than 0.97) at the groove width of less than 0.200 mm. Consequently, it has been found that the groove width is set preferably to a minimum of 0.2 mm or greater and more preferably to 0.4 mm or greater.

Figure 16:
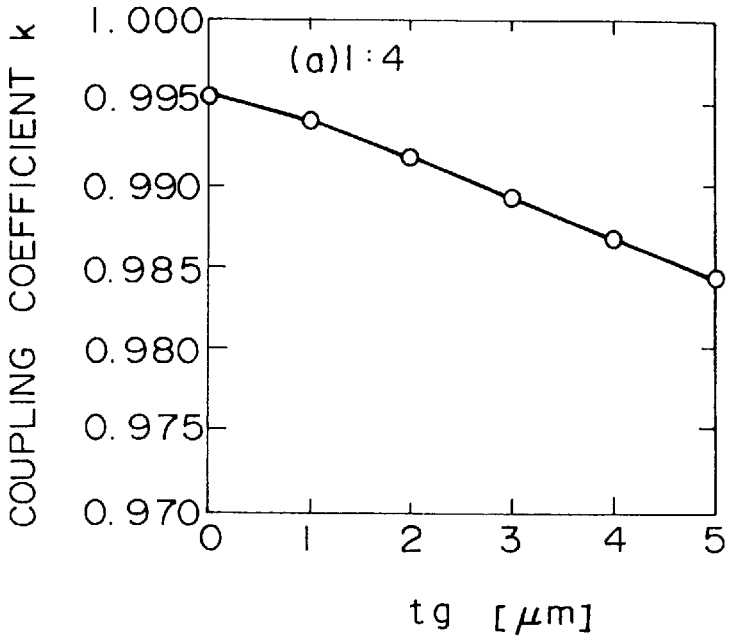
FIG. 16 is a graph showing the relationship between the gap width $t_g$ and coupling coefficient of the plane transformer in which the turn ratio is set to 1:4 in the example.

FIG. 16 shows coupling efficient found when the groove width $W_c$ was set to 0.400 mm and the distance $t_g$ (the thickness of the gap insulating layer) between the substrates was used as a parameter in a plane transformer having two separated primary plane coils and the turn ratio of 1:4 as shown in FIGS. 7 and 8, with respect to the above-described plane transformer.

From results shown in FIG. 16, it is apparent that the coupling coefficient is 0.996 when no gap insulating layer is provided, but decreases in accordance with an increase in the thickness of the gap insulating layer, and is 0.985 when $t_g$=5 $\mu$m. However, even such a value sufficiently lie within the allowable range.

Figure 17:
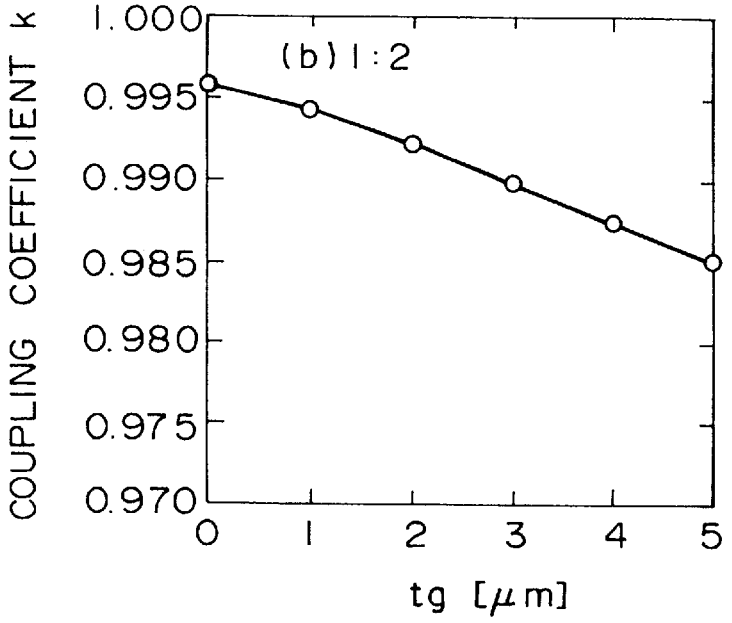
FIG. 17 is a graph showing the relationship between the gap width and coupling coefficient of the plane transformer in which the turn ratio is set to 1:2 in the example.

In addition, FIG. 17 shows the result of performing an experiment similar to the above by using a plane coil (whose turn ratio is 1:2 which is produced such that a primary plane coil having a structure as shown in FIGS. 1 to 3 is fitted in a fitting groove having the same measurements as the above.

The result shown in FIG. 17 also shows a tendency similar to the result shown in FIG. 16. It is apparent that, when no gap insulating layer (an arrangement in which a substrate plate is bonded to a substrate without a gap insulating layer provided therebetween) is provided, the coupling coefficient is 0.996, but decreases in accordance with an increase in the thickness of the gap insulating layer, and is 0.985 at $t_g$=5 $\mu$m. However, even such a value sufficiently lie within the allowable range.

The foregoing results show that the employment of the present invention enables a high coupling coefficient at any of the output ratios.

Figure 14:
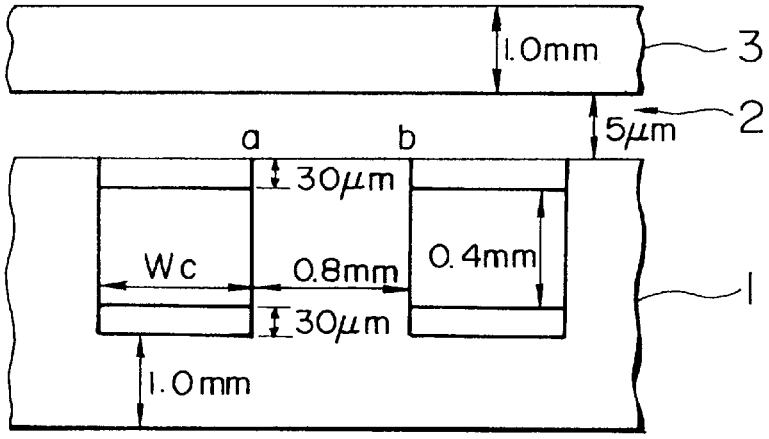
FIG. 14 is a side view illustrating the measurements of portions of the plane transformer produced in one example.
Figure 18:
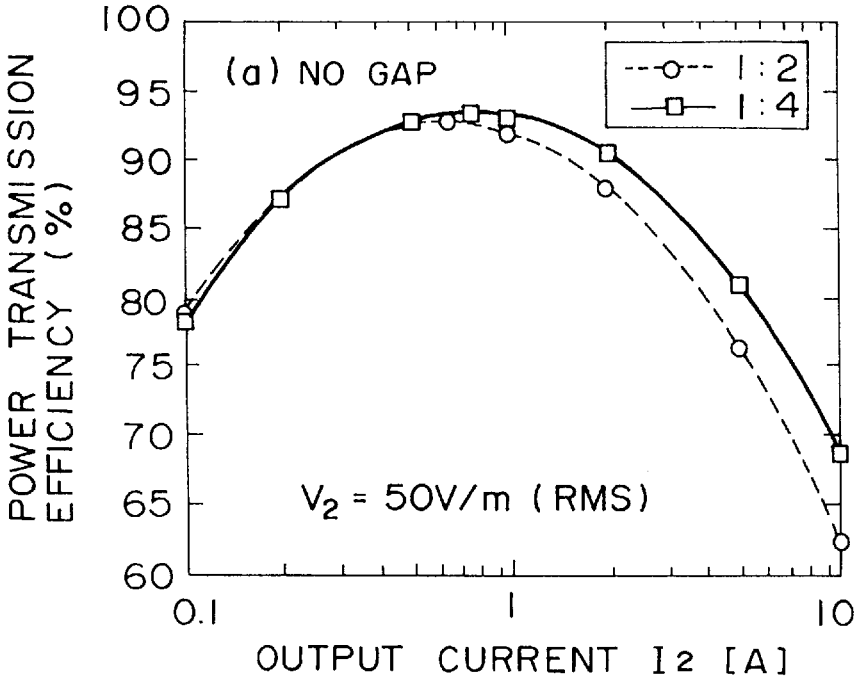
FIG. 18 is a graph showing the relationship between the current and power transmission efficiency of the plane transformer in which no gap is formed in the example.
Figure 19:
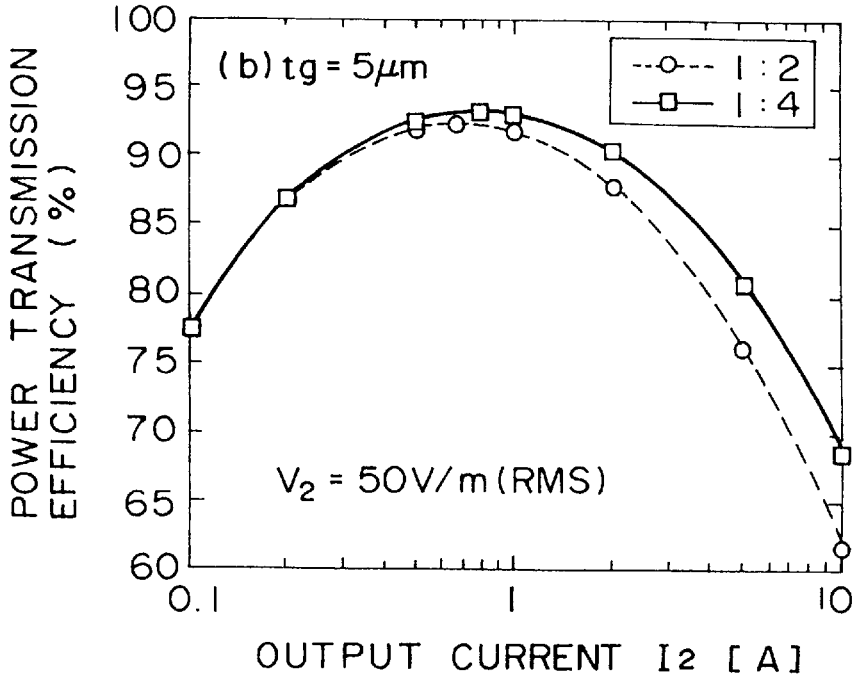
FIG. 19 is a graph showing the relationship between the current and power transmission efficiency of the plane transformer in which the gap is set to 5 μm in the example.

When an output voltage $V_2$=50 V (effective value) per 1 m conductor of the secondary plane coils was maintained to be constant, the average magnetic flux density amplitude (maximum value) between a and b shown in FIG. 14 with no load measured approximately 0.028 T. In FIGS. 18 and 19, power transmission efficiency measured when the secondary plane coils were connected to a load of pure resistance and an output current $I_2$ in the secondary plane coils are shown.

FIG. 18 shows power transmission efficiency measured when no gap insulating layer was provided. The turn ratio of 1:4 causes a maximum efficiency of 93.3% at $I_2$=0.77 A, and the turn ratio of 1:2 causes a maximum efficiency of 92.5% at $I_2$=0.66 A. FIG. 19 shows power transmission efficiency measured when the gap was set to 5 $\mu$m. The turn ratio of 1:4 causes a maximum efficiency of 93.1% at $I_2$=0.78 A, and the turn ratio of 1:2 causes a maximum efficiency of 92.2% at $I_2$=0.67 A. When the output current is large, the copper loss increases greater than the core loss, and the copper loss is proportional to a square of the current, thus, it is considered that the turn ratio of 1:4 which causes the primary current to be a half, compared with the turn ratio of 1:2, is advantageous in efficiency.

From the above comparison, in connection with the present invention in which the gap insulating layer is provided and in which no gap insulating layer is provided, the arrangement in which no gap insulating layer is provided is slightly advantageous in coupling and efficiency. The arrangement forms a closed magnetic circuit, thus, magnetic flux concentrates around the coils where an exciting current is present, which causes a problem of heat generated by partial magnetic saturation and concentration of core loss. Therefore, it is preferable to use the arrangement in which the gap is provided.

Figure 20:
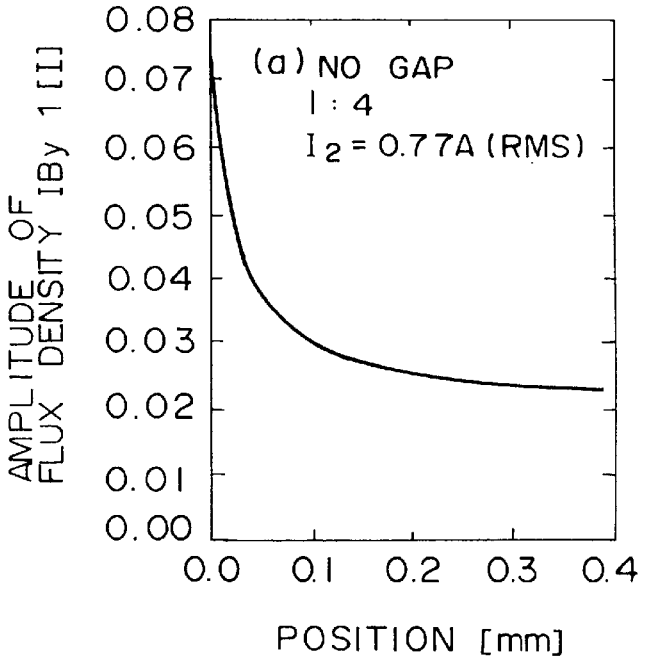
FIG. 20 is a graph showing the relationship between the position and magnetic flux density of the plane transformer in which no gap is formed in the example.
Figure 21:
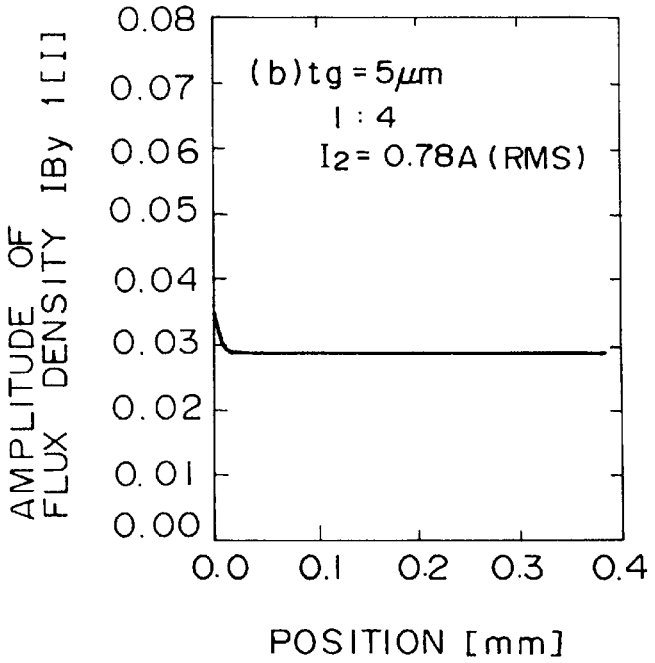
FIG. 21 is a graph showing the relationship between the position of the plane transformer and the magnetic flux amplitude in which the gap is set to 5 μm in the example.

FIGS. 20 and 21 show the distributions of the vertical component amplitude (maximum) of the magnetic flux density between a and b shown in FIG. 14, measured when the plane transformer having a turn ratio of 1:4 was operated at maximum efficiency points shown in FIGS. 18 and 19.

In FIGS. 20 and 21, each horizontal axis designates the location of a-b, using the distance from the position a. The distance between a and b is 0.8 mm, and a position which is 0.4 mm apart from the position a is the central point. Since the right and the left of the central point are symmetrical, only portions positioned up to 0.4 mm from the point a are shown.

In the arrangement in which no gap is provided as shown in FIG. 20, as the magnetic flux approaches the position a, the vertical component amplitude greatly increases. From the comparison between the position a and the intermediate point of the positions a-b, it is found that the magnetic flux density at the position a is three times that at the intermediate position. On the contrary, according to the arrangement in which the gap insulating layer having a thickness of 5 $\mu$m is provided, the distribution of the vertical component amplitude is almost flat as shown in FIG. 21.

Accordingly, an arrangement having a closed magnetic circuit structure is formed by eliminating a gap, however, in this arrangement it is necessary to reduce the whole magnetic flux density by increasing the cross-sectional area of the magnetic circuit so that the magnetic flux density is not saturated in a portion such as the position a where the magnetic flux density is large. Thus, efficiency in which the magnetic substance is used deteriorates, and the substrate has a large size, which causes a tendency in which the whole of the transformer becomes large-sized.

In addition, local magnetic flux results in local heat generated by core loss, which causes a need for sufficient consideration of heat design. Therefore, it has been found that the arrangement in which the gap insulating layer is provided according to the present invention is more preferable.

What is claimed is:

1. A plane transformer comprising:

a plurality of substrates comprised of magnetic materials;

a gap insulating layer provided between said substrates;

a primary plane coil;

a main-insulating layer; and a plurality of secondary plane coils;

wherein said primary plane coil, said main insulating layer, and said secondary plane coils being fitted in a fitting groove in one of said substrates;

wherein said fitting groove is formed on one surface of one of said plurality of substrates, said fitting groove having a shape fit for the overall shape of each plane coil, and said primary plane coil, said main-insulating layer and said secondary plane coils are fitted in said fitting groove;

wherein one of said plurality of secondary plane coils comprises middle plane coil that is stacked between an upper plane coil which consists of either said primary plane coil or a second of said plurality of secondary plane coils and a lower plane coil which consists of said primary plane coil or said second of said plurality of secondary plane coils;

wherein the cross-sectional widths of the upper plane coil and the lower plane coil are shorter than the cross-sectional width of said middle plane coil;

wherein said primary plane coil or one of said plurality of secondary plane coils has an overall length and is separated into two plane coil sections along a center line extending over the overall length thereof and the two plane coil sections are positioned side by side in the fitting groove and are mutually connected to form a continuous plane coil.

2. A plane transformer according to claim 1, wherein said plane coils are formed in the shape of a meander or vortex.

3. A plane transformer according to claim 1, wherein the thickness of said gap insulating layer is between 1 and 50 $\mu$M.

4. A plane transformer according to claim 1, wherein the width of said fitting groove is between 0.2 and 2 mm.

5. A plane transformer according to claim 1, wherein said main-insulating layer or a gap insulating layer disposed between said primary plane coil and said secondary plane coils consists of one resin selected from the group of polyvinyl chloride, polystyrene, polypropylene, polyethylene, polycarbonate, polyester, fluororesin like polyethylene tetrafluoride, polyimide, polyethyleneterephthalate, nylon, and epoxy resin.

6. A plane transformer according to claim 1, wherein each of said secondary plane coils includes a layer of foil composed of a conductive material and a resin film.

7. A plane transformer according to claim 1 wherein:

said plurality of substrates includes a first substrate and a second substrate;

said at least one fitting groove includes a first fitting groove formed on a surface of said first substrate;

said at least one fitting groove includes a second fitting groove formed on a surface of said second substrate;

said primary plane coil is fitted into said first fitting groove;

said secondary plane coils are fitted into said second fitting groove.

8. A plane transformer according to claim 7 wherein:

said first substrate and said second substrate are positioned with respect to each other such that said surface of said first substrate faces said surface of said second substrate and that said first fitting groove is aligned with said second fitting groove.

9. A plane transformer according to claim 7 wherein a first portion of said main insulating layer is fitted in said first fitting groove and a second portion of said main insulating layer is fitted in said second fitting groove.

10. A plane transformer according to claim 1, wherein the cross-sectional width of said middle plane coil is 0.2 to 2.0 mm, and the cross-sectional width of said upper plane coil is half of the cross-sectional width of said middle plane coil.

11. A plane transformer comprising:

a plurality of substrates comprised of magnetic material;

a primary plane coil; and at least one secondary plane coil;

wherein said primary plane coil and said at least one secondary plane coil are fitted in a fitting grove on one surface of at least one of said plurality of substrates; and said plurality of substrates being separated by a gap insulating layer, wherein said primary plane coil or said at least one secondary plane coil has an overall length and is separated into two plane coil sections along a center line extending over the overall length thereof and the two plane coil sections are positioned side by side in the fitting groove and are mutually connected to form a continuous plane coil.

12. A plane transformer according to claim 11, wherein the magnetic material includes Mn—Zn ferrite.

13. A plane transformer according to claim 11, further comprising a main insulating layer, the main insulating layer being fitted in said fitting groove.

14. A plane transformer according to claim 11, wherein:

said plurality of substrates includes a first substrate and a second substrate and said fitting groove is formed on a surface of said first substrate.

15. A plane transformer according to claim 11, wherein said plane coils are formed in the shape of meander or vortex.

16. A plane transformer according to claim 11, wherein the thickness of said gap insulating layer is between 1 and 50 $\mu$m.

17. A plane transformer according to claim 11, wherein the width of said fitting groove is between 0.2 and 2 mm.

18. A plane transformer according to claim 11, wherein said gap insulating layer consists of one resin selected from the group of polyvinyl chloride, polystyrene, polypropylene, polyethylene, polycarbonate, polyester, fluororesin like polyethylene tetrafloride, polyimide, polyethyleneterephthalate, nylon, and epoxy resin.

19. A plane transformer according to claim 11, wherein said at least one secondary plane coil includes a layer of foil composed of a conductive material and a resin film.

20. The plane transformer of claim 11, wherein the gap insulating layer has a dielectric constant of between 2 to 4.

* * * * *

UNITED STATES PATENT AND TRADEMARK OFFICE

CERTIFICATE OF CORRECTION

PATENT NO. : 6,060,976
DATED : May 9, 2000
INVENTOR(S) : T. Yamaguchi et al.

It is certified that error appears in the above-identified patent and that said Letters Patent is hereby corrected as shown below:

Title page,
Column 1, item [73], after "of" please insert -- Tokyo, --.

Claim 11,
Line 6, please change "grove" to -- groove --.

Claim 18,
Line 5, please change "tetrafloride" to -- tetrafluoride --.

Signed and Sealed this

Eleventh Day of September, 2001

*Attest:*

Nicholas P. Godici

*Attesting Officer*

NICHOLAS P. GODICI
*Acting Director of the United States Patent and Trademark Office*